United States Patent [19]

Fattori

[11] Patent Number: 4,850,724

[45] Date of Patent: Jul. 25, 1989

[54] CONTROL CIRCUIT FOR DOT MATRIX PRINTING HEAD

[75] Inventor: Franco Fattori, Rho, Italy

[73] Assignee: Honeywell Bull Italia S.p.A., Caluso, Italy

[21] Appl. No.: 170,474

[22] Filed: Mar. 21, 1988

[30] Foreign Application Priority Data

Apr. 30, 1987 [IT] Italy ..... 20322 A/87

[51] Int. Cl.[4] ..... B41J 9/38

[52] U.S. Cl. ..... 400/157.2; 400/121; 400/124

[58] Field of Search ..... 400/157.2, 167; 101/93.02, 93.03, 93.04; 361/153

[56] References Cited

U.S. PATENT DOCUMENTS 4,473,311 9/1984 Sakaida ..... 400/157.2
4,637,742 1/1987 Sakai ..... 400/121
4,741,636 5/1988 Takahashi ..... 400/124
4,743,821 5/1988 Hall ..... 400/124

*Primary Examiner*—Paul T. Sewell
*Assistant Examiner*—Steven Kelley
*Attorney, Agent, or Firm*—J. H. Phillips; J. S. Solakian

[57] ABSTRACT

Control circuit for a dot matrix printing head of the permanent magnetic type or simple electromagnet type, wherein a printing element is subjected to a variable magnetic flux, owing to an energization current and/or to a movable armature movement, which causes an energization current to be established in the printing element for its actuation. The energization current is switched off for the deactivation of the printing element and which thereafter establishes a shorting path letting a current, induced in the printing element by mangetic flux changes due to the movable armature movement, to flow in the printing element, with a damping effect on the armature movement.

3 Claims, 2 Drawing Sheets

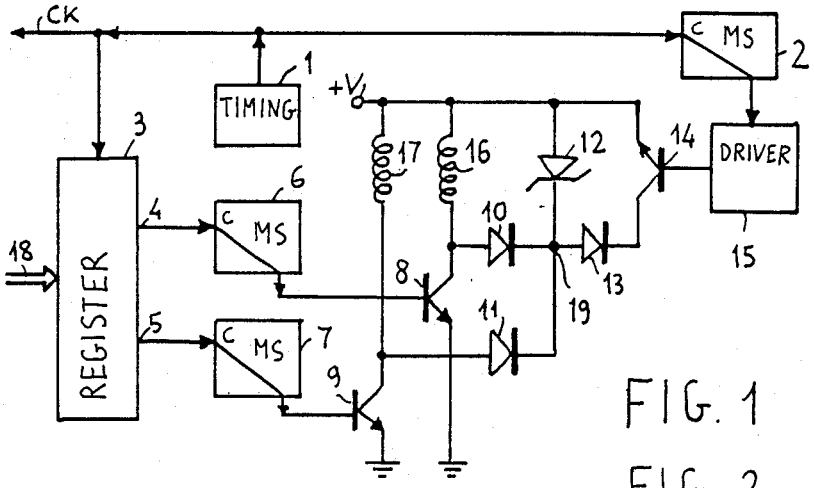
FIG. 1
FIG. 2
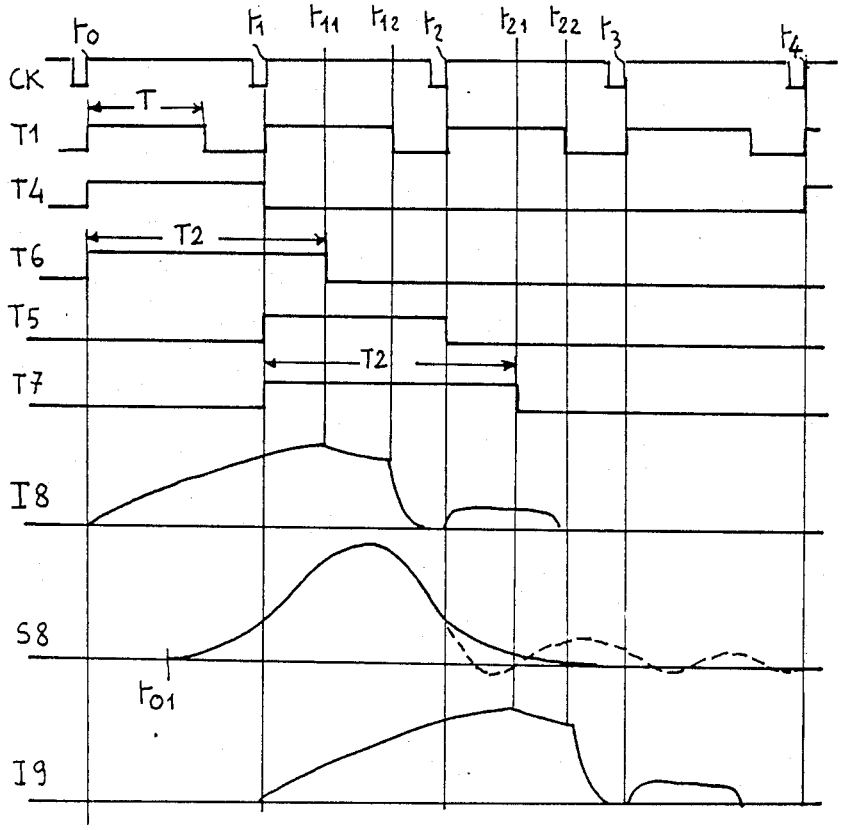

CONTROL CIRCUIT FOR DOT MATRIX PRINTING HEAD

BACKGROUND OF THE INVENTION

The present invention relates to a dot matrix printing head, and more particularly, to a control circuit for a dot matrix permanent magnet printing head.

It is known that serial printers, using printing needles or the like, are widely spread on the market. In such printers several electromagnets are selectively energized, each one for causing the impact of a printing element, usually a needle, against a printing support. Two kinds of printing heads are basically used, the one with a simple electromagnet and the one with a permanent magnet.

In the simple electromagnet type print heads, each electromagnet is normally deenergized. The energization causes the attraction of an armature which, in turn, causes the movement of the printing element. In the permanent magnet type print heads, a permanent magnet maintains a plurality of resilient armatures in attracted and bent position. A winding, coupled with the permanent magnet circuit, is associated with each one of the armatures. The selective energization of the various windings causes the neutralization of the magnetic field produced by the magnet on the related armatures, and the release of the related armatures, which in turn causes the movement of the related printing elements.

The performances attainable by these print heads are heavily dependent on the control circuits which cause their energization and on their mechanical characteristics. In order to obtain high performances it is required to impart to the energization (or demagnetization) windings a high current in a very short time, to maintain such current for a suitable time, and then to remove such current in a very short time. The energization cycle defines, but for a certain hysteresis, the mechanical displacement cycle of the armature, at the end of which the armature returns to its rest position. However, when the armature reaches its rest position, it is affected by a remarkable speed imparted by the returning means (resilient or magnetic). Therefore it tends to strike against a stop element and to rebound with an oscillatory phenomena which, in spite of the damping elements usually provided, end in a settling period which normally has a duration not lesser than the duration of the energization cycle. The armature vibration and its impact against the stop element are a further cause of noise, whose intensity is greater the greater the kinetic energy, that is, the armature speed and consequently the vibration amplitude.

The requirement to have a repetitive and uniform behavior in the course of subsequent printing operations imposes that an armature must be energized when it is in stable rest position, thus an actuation period not less than the sum of the energization cycle duration and the settling period duration. The performances of the dot printing heads are therefore limited by energization cycle duration and by the settling time. Several arrangements have been proposed. On one side they aim to shorten the energization cycle duration by means of energization circuits which produce current pulses of rectangular shape. On the other side they aim to shorten the duration of the settling period by means of mechanical dampeners, pneumatic, resilient dampeners or the like.

It is the object of the present invention to provide a circuit which not only allows for the generation of very short energization cycles, with current pulses very close to a rectangular shape, but also allows for a reduction of the settling period of the armatures in a printing head, as well as a reduction of the noise they produce, by performing a damping action which may cumulate with the one provided by other possible devices.

A further object of the present invention is to provide a driving circuit which may control a dot matrix printing head to obtain quality print characters designed according to a high resolution matrix, the circuit being simple and inexpensive.

These results are achieved by providing a driving circuit where a plurality of windings may be selectively energized by individual control circuits, while a common transistor switch, periodically closed, periodically establishes and interrupts a current recycle path which maintains the energization current for a preestablished time interval, interrupts it when required, then enables, with a next reclosure, the circulation of induced currents which have a damping effect on the armatures. The closing/opening of the common transistor switch, does not affect the energization of the windings even if the energization period is longer than the closing/opening period of the common transistor. This allows for the execution of impressions according to a dot matrix having an high resolution.

These and other features of the invention and its advantages of the present invention will become more apparent from the following description of a preferred form of embodiment of the invention and of some variants thereof.

SUMMARY OF THE INVENTION

Therefore, there is provided by the present invention, a control circuit for a dot matrix printing head which comprises a plurality of printing elements individually energizable by a current associated therewith. A plurality of control switch elements, each control switch element associated with a corresponding printing element, controls the corresponding individual energizing current. A current recirculating path element, operatively connected to each of the control switch elements and each of the printing elements, provides an apparent high resistance path for the individual energizing currents. Also included is a shorting switch element, operatively connected across the current recirculating path elements. A timing element, operatively connected to the shorting switch element, generates a timing signal. A control element, operatively connected to the plurality of control switch elements and to the timing element, has input terminals adapted to receive a binary code, for selectively controlling the control switches for a predetermined time period T2 in response to the binary code during an active period determined by the timing signal. The timing signal has a period P equal to or lesser than predetermined time period T2. The shorting switch element periodically switches on for a time period T in response to the timing signal during a predetermined portion of the timing signal, the time period T being lesser than the period P.

Accordingly, it is an object of the present invention to provide a circuit which reduces the setting period of printing elements in a printing head.

It is another object of the present invention to provide a circuit for a dot matrix printing head which reduces the setting period of the printing elements in the printing head.

It is still another object of the present invention to provide a circuit for a dot matrix printing head which reduces the setting period of the printing elements and reduces the noise produced by the printing elements of the printing head.

These and other objects of the present invention will become more apparent when taken in conjunction with the following description and attached drawings, wherein like characters indicate like parts, and which drawings form a part of the present application.

BRIEF DESCRIPTION OF THE DRAWINGS

FIG. 1 is the electrical drawing of a printing head control circuit in accordance with the invention;

FIG. 2 shows a timing diagram of the signals present at some points of the circuit of FIG. 1;

DETAILED DESCRIPTION

Figure 3:
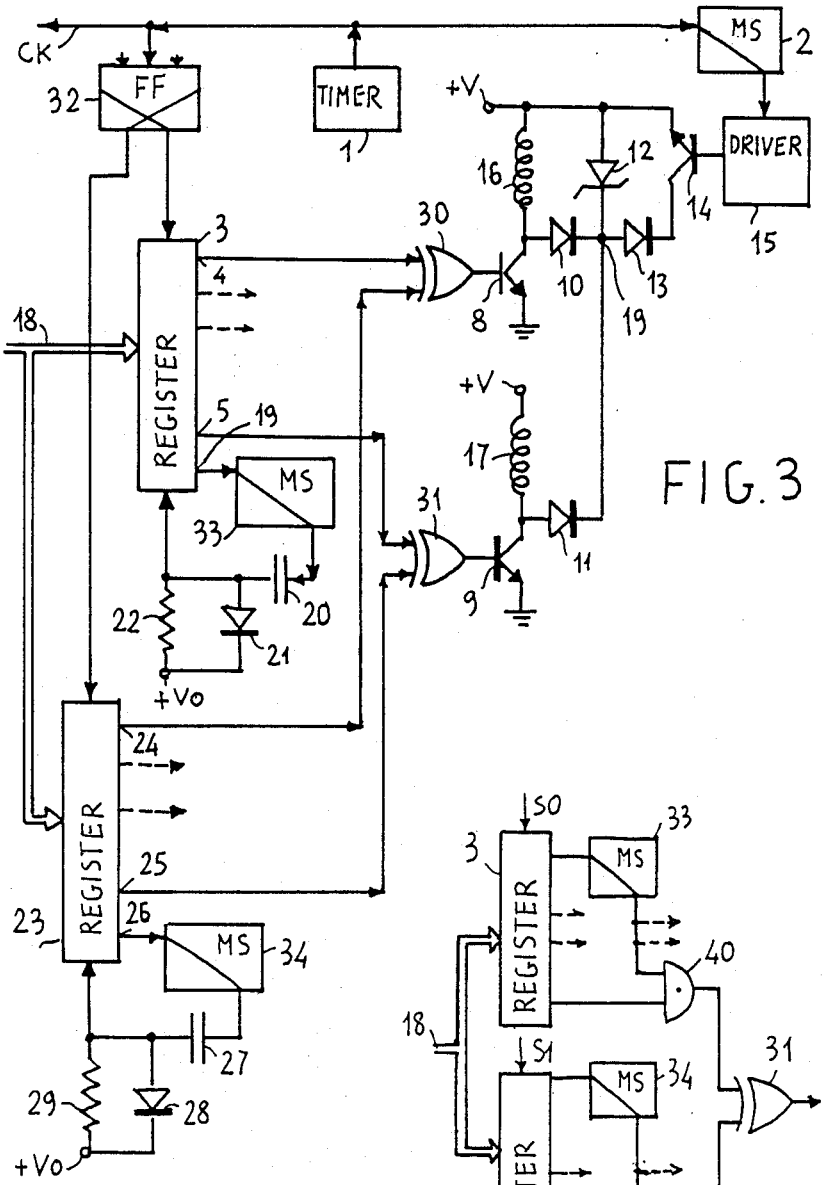
FIG. 3 shows the electrical drawing of a second printing head control circuit in accordance with the invention.

Referring to FIG. 1, there is shown a block diagram of the preferred embodiment of the present invention. The print head control circuit 100 of FIG. 1 comprises a timing unit 1, a first univibrator 2 (MS), and sometimes referred to herein as a one-shot or a monostable multivibrator, a register 3, a plurality of univibrators 6,7, a plurality of transistors 8,9 a plurality of diodes 10,11 a zener diode 12, a diode 13, a transistor 14 and a driving circuit 15 for transistor 14. The circuit 100 is used to control the selective energization of a plurality of windings 16,17 of a printing head. For sake of simplicity only two windings are shown, and consequently the circuit is shown as comprising only two transistors 8,9, two diodes 10,11, two univibrators 6,7 and two outputs 4,5 from register 3 but it is clear that such elements are provided in number equal to the number of windings to be controlled, generally 7,9 or more.

The operation of the circuit 100 will now be described with reference to FIG. 1 and the timing diagram of FIG. 2. Referring to FIG. 1, timing unit 1 generates a periodic timing signal CK (for instance a signal at logic level 1 interrupted by short pulses at logic level 0) which is coupled to a printer control unit (not shown) and fed to the clock input (C) of univibrator 2 and register 3. On receipt of the falling edge of CK the printer control unit (not shown) forwards, through a channel 18, a binary code or printing pattern to register 3, which by the rising edge of signal CK, loads the code and outputs it on outputs 4,5. The code defines by each of its bits, which of the windings have to be energized. The rising edge of signal CK further triggers univibrator 2 which, at each triggering, produces at its direct output, a pulse at logical level 1, the pulse having a predetermined duration lesser than the period of signal CK.

The outputs 4,5 of register 3 are connected to the clock input of univibrators 6,7 respectively, and if the logical level at outputs 4,5 raises from 0 to 1, the univibrators 6,7 are respectively triggered and produce at the direct output a pulse at logical level 1 having a predetermined duration. The output of univibrators 6,7 is respectively connected to the base of transistors 8,9, in the preferred embodiment being of the NPN type. The emitter of the two transistors 8,9 is connected to ground. The collector of transistors 8,9 is connected to a terminal of windings 16,17 respectively. The other terminal of the two windings 16,17 is connected to a voltage source +V. The collector of the two transistors 8,9 is further connected to the anode of diodes 10,11 respectively. Diodes 10,11 have their cathode connected to a common node 19.

Zener diode 12 has the cathode connected to node 19 and the anode connected to the voltage source +V. Diode 13 has the anode connected to node 19 and the cathode connected to the collector of transistor 14, in the preferred embodiment being of the NPN type, and having the emitter of transistor 14 connected to the voltage source +V. The output of univibrator 2 is connected to the input of the driving circuit 15, the output of the driver being connected to the base of transistor 14.

The driving circuit 15 has the function of converting the logical signal present at the input into a biasing voltage for the base of transistor 14 as to the voltage +V. Therefore it may comprise a transformer driving circuit, or a voltage translation and power/impedance matching circuit well known in the art.

For sake of clearness the outputs of univibrators 6,7 are shown as directly driving transistors 8 and 9 but it is clear that even here intermediate signal impedance and power adapters can be provided.

Referring now to FIG. 2, the operation of the circuit 100 may be easily understood with reference to the timing diagrams. Diagram (or waveform) CK shows the timing signal produced by timer 1. An instant t0,t1,t2,t3,t4 of print operation start corresponds to each timing pulse. It is reminded that dot matrix print heads are used to perform the serial printing of characters owing to the movement of the printing head along a printing line, the printing elements of the print head being arranged in one or more vertical columns. Therefore times t0, . . . tN define and correspond to spaced columns of a virtual printing matrix where the dots composing a character may be located. Typically the period of signal CK may be in the order of 200 usec. Diagram T1 shows the logical level of the signal at the output of univibrator 2, hence the ON-OFF status of transistor 14. Diagram T4 shows the logical level of the signal present at the output 4 of register 3 in the assumption that at times t0 and t4 register 3 is loaded to control the energization of winding 16. Diagram T6 shows the logical level at the output of univibrator 6 as a consequence of signal T4. It further shows the ON-OFF status of transistor 8.

Likewise, diagrams T5 and T7 shows the logical level at the output 5 of register 3 and at the output of univibrator 7 in the assumption that at time t1 register 4 is loaded to control the energization of winding 17.

Diagrams I8 and I9 shows in qualitative form, the current flowing in windings 16,17, respectively. Diagram S8 shows in qualitative form the stroke of the armature controlled by winding 16. It may be noted that at each of times t0,t1,t2,t3,t4, signal T1 rises to a logic 1 for a duration T corresponding to the activation time of univibrator 2 and that signals T6 and T7 rises to a logic 1, when the corresponding univibrators 6,7 are activated, for a duration T2 corresponding to the activation time of univibrators 6 and 7, respectively. At time t0 transistor 8 is switched on and a current starts flowing in winding 16 establishing a magnetic field which opposes to the one generated by a permanent magnet. At time t01 the magnetic field is neutralized at an extent sufficient to enable the disengagement or releasing of the armature, which tends to depart, with increasing speed, from the attracting magnetic pole.

Meanwhile, current in winding 16 further increases even if at a lower rate, owing to the increasing reluctance of the magnetic circuit, until the switching off, at time t11, of transistor 8. It must be noted that during such time interval, from time t0 to time t11, the status of transistor 14 is irrelevant, i.e. it may be indifferently switched on or switched off.

At time t11 the current flowing in winding 16 cannot further flow in transistor 8, but can flow in the low impedance path comprising diodes 10,13 and transistor 14, which is switched on. Therefore it slowly decays until time t12, at which signal T1 (which controls transistor 14) drops to 0. At this point the current flowing in winding 16 is compelled to flow in the circuit having an high apparent resistance comprised of diode 10 and of zener diode 12 and quickly decay to 0. The permanent magnet action is no longer neutralized and the armature is attracted towards the magnetic pole.

At time t2, when the armature is still moving towards the magnetic pole with increasing speed, signal T1 rises again to a logic 1 and transistor 14 is switched on. The change in the magnetic circuit reluctance due to the armature movement causes a magnetic flux change (increase) which in turn induces electromotive(e.m.) force in winding 16. This e.m. force causes a current in winding 16, which current flows through diodes 10,13 and transistor 14 and which has a neutralizing effect on the magnetic field. Correspondingly, the armature is braked in its movement, by the increasing resilient bending and approaches the magnetic pole with a stroke shown by the solid line of diagram S8, that is with a decreasing speed.

At time t22, when transistor 14 is again switched off, the current in winding 16 is compelled to drop to 0 and therefore the neutralizing effect on the attracting magnetic field ceases, the armature is close to or has already reached the magnetic pole, with a neglectable kinetic energy, which does not cause any appreciable rebounding. Therefore at time t3 the armature coupled to winding 16 is in stable position and ready for a new printing operation. Without the damping action caused by the current induced in winding 16 the stroke of the armature would be as shown by the dotted line of diagram S8, with evident oscillatory phenomena which would prevent the start of a new printing operation at least until time t4.

The intermittent and periodical activation/deactivation of transistor 14 with a period lesser than the interval T2 of the windings energization is therefore suitable to provide an effective damping of the armatures movement and allows obtaining a performance increase. In addition it does not preclude and does not interfere with the energization of different printing elements at time intervals lesser than the energization time interval T2.

Time interval t1–t21 may be considered, during which, by way of example, transistor 9 is switched on and correspondingly the current in winding 17 increases (Diagram I9). Even if during time interval t12–t2 signal T1 drops to 0 and correspondingly transistor 14 is switched off, this does not affect the current flowing in winding 17 which anyway finds its path in transistor 9 which is switched on. As a consequence the described control circuit is suitable for the control of printing elements with a period of signal T1 lesser than the energization period T2 of the same printing elements and by the more lesser than the repetition period of the energization of the same printing element.

The printing of a character by dot composition may therefore be performed according to a virtual matrix having a high number of printing columns, each defined, as known, by a control time t0,t1,t2,tN and further, thanks to the damping action performed by the control circuit, the energization repetition period for the same printing element may be shortened (for instance from t0 to t3) instead of from t0 to t4). It must be noted that the considerations already made are true to some extent even in the control of a printing head having simple electromagnets, the only difference being that the damping action, is weaker and essentially due to the residual magnetism of the magnetic circuit.

FIG. 3 shows an alternative embodiment of the invention which provides further advantages in that it minimizes the number of univibrators required to control the different printing elements; but adds circuit complexity and cost.

In the control circuit of FIG. 3 several elements are the same and perform the same function of those shown in FIG. 1, thus are referenced by the same reference number. The control circuit of FIG. 3 comprises, in addition to timer 1, univibrator 2, driving circuit 15, transistors 8,9, diodes 10,11,13, zener diode 12 and register 3, a further flip flop 32 a second register 23 and a plurality of EX OR gates, two only of which 30, 31 are shown. The plurality of univibrators 6,7 of FIG. 1 is replaced by a pair of univibrators 33,34 respectively coupled to registers 3 and 23.

Timing unit 1, in addition to periodically activating univibrator 2, provides flip flop 32, of J,K type, with a clock signal which periodically, with the raising edge of signal CK, causes it to toggle. Flip flop 32 acts as a frequency divider and produces at its direct and inverted output a signal S0,S1 respectively which raises from level 0 to level 1 with a frequency half the one of signal CK. Signals S0, S1 are input respectively to the clock input of registers 3,23. Channel 18 is connected both to the inputs of register 3 and register 23.

Register 3 and 23 are alternatively loaded with a printing pattern and with a command at logical level 1 for activation of the printing elements, the command being available at output 19 and 26 respectively of the two registers. The outputs 4 and 24, respectively of registers 3,23, are connected to the inputs of the EX OR gate 30, whose output is connected, through driving circuits if required, to the base of transistor 8. Likewise the outputs 5 and 25, of registers 3,23 respectively, are connected to the inputs of the EX OR gate 31, whose output is connected to the base of transistor 9. Other outputs of the two registers are connected to the inputs of other EX OR gates (not shown) for controlling further transistor switches.

Output 19 of register 3 is connected to the input of univibrator/ timer 33 whose output is connected, through a derivative network comprising capacitor 20, resistor 22 and diode 21, to the reset input of register 3. Likewise, the output 26 of register 23 is connected to the input of univibrator 34, whose output is connected, through a derivative network comprising capacitor 27, resistor 29 and diode 28, to the reset input of register 23.

The operation of the control circuit of FIG. 3 is quite simple to that of FIG. 1. The two registers 3, 23 are alternatively loaded by the printer controller at each CK signal, each one being periodically loaded, with a period which is twice the period of signal CK. At each loading operation the corresponding univibrator 33, 34 is activated for a period T2, which is greater than the period of signal CK and lesser than or equal to two times the period of signal CK. At the end of the activation period the corresponding register 3,23 is reset. As a consequence the two registers 3,23 provide in output, through the EX OR gates 30,31, energization commands to the several printing elements, having a duration equal to T2 and beginning at different time instants, respectively t0, t2, T4 or t1, t3 depending on the register 3 or 23 which has generated the commands.

Obviously, if one of the two registers controls the energization of a printing element, the other register must not control, with the next subsequent loading, the energization of the same printing element, but only the energization of other printing elements. The use of EX OR gates, instead of common OR gates, provides an intrinsic protection and assures that, in case of overlapped energization of the same printing element by the two registers, as a consequence of malfunctioning or error in the control unit, the energization of the printing element is interrupted.

The circuit of FIG. 3 is only one of the several variants which may be imparted to the circuit of FIG. 1. It is clear that several other changes and modifications can be made within the spirit and scope of the present invention.

In particular, the activation period T of transistor 14 may be varied in phase relative to signal CK depending on the needs, so that the switch off interval of transistor 14 occurs at the beginning of the intervals defined by clock signal CK (for instance by controlling the driving circuit 15 with the inverted output of univibrator 2) or is centered as to such intervals, or bridges two subsequents of such intervals (for instance by means of a further univibrator cascaded to univibrator 2).

Figure 4:
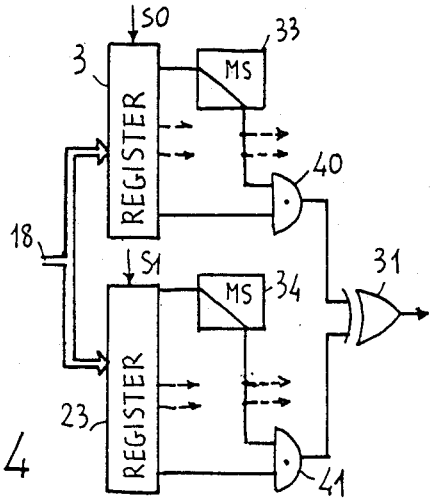
FIG. 4 shows a modification of the control circuit of FIG. 3.

Further, in the drawing of FIG. 3 the outputs of univibrators 33 and 34, rather than controlling the reset of register 3,23 could respectively enable, for the predetermined duration T2, a first set of logical AND gates interposed between the outputs of register 3 and the inputs of the EX OR gates 30 . . . 31 and a second set of AND gates interposed between the outputs of register 23 and the inputs of EX OR gates 30 . . . 31. FIG. 4 partially shows the embodiment of this alternative, and specifically shows the AND gates 40, . . . 41 interposed between the outputs 5,25 of registers 3,23, respectively, and the inputs of EX OR gate 31.

While there has been shown what is considered the preferred embodiment of the present invention, it will be manifest that many changes and modifications can be made therein without departing from the essential spirit and scope of the invention. It is intended, therefore, in the annexed claims to cover all such changes and modifications which fall within the true scope of the invention.

I claim:

1. A control circuit for a dot matrix printing head, comprising:

(a) a plurality of printing elements individually energizable by a current and associated therewith;

(b) a plurality of control switch means, each control switch means associated with a corresponding printing element, for controlling the corresponding individual energizing current;

(c) a current recirculating path means connected to each of said control switch means and each of said printing elements, for providing an apparent high resistance path for the individual energizing currents;

(d) shorting switch means connected across said current recirculating path means to selectively enable a low resistance current recirculating path (e) timing means coupled to said shorting switch means, for generating a timing signal; and (f) control means coupled to said plurality of control switch means and to said timing means, said control means having input terminals adapted to receive a binary code, for selectively controlling said control switches for a predetermined time period T2 in response to said binary code during an active period determined by said timing signal, wherein said timing signal has a period P equal to or lesser than predetermined time period T2, and further wherein said shorting switch means periodically switches on for a time period T in response to said timing signal during a predetermined portion of said timing signal, said time period T being lesser than said period P.

2. Control circuit as claimed in claim 1, wherein said control means comprises:

(a) register periodically loaded with said binary code by said timing signal; and (b) a plurality of timing elements, one for each printing element, each timing element triggered by a transition from a first logical level to a second logical level of a corresponding output of said register, for generating a switch on command, said switch on command being coupled to the corresponding control switch means, each of said control switches having an on-time for the predetermined time period T2.

3. Control circuit as claimed in claim 1, wherein said control means comprises:

(a) a first (3) and a second (23) register, each periodically and alternatively loaded, in a mutually exclusive way in response to said timing signal;

(b) a plurality of OR gates, one for each printing element, each OR gate having a first input for receiving a first signal from said first register, a second input for receiving a second signal from said second register, and an output for controlling the corresponding individual energizing current of the related printing element; and (c) a first and a second timer, respectively triggered jointly with the loading of said first and second register, each for generating a control signal at a first logic level, having a predetermined duration T2 beginning with the related triggering, and thereafter, at a second logic level, control said second logic level for switching off said related control switches.

* * * * *